United States Patent [19]

Molins

[11] 4,073,300

[45] Feb. 14, 1978

[54] METHOD OF MAKING RUSSIAN CIGARETTES

[75] Inventor: Desmond Walter Molins, London, England

[73] Assignee: Molins Limited, London, England

[21] Appl. No.: 630,518

[22] Filed: Nov. 10, 1975

[30] Foreign Application Priority Data

Nov. 15, 1974 United Kingdom ..... 49663/74
Feb. 5, 1975 United Kingdom ..... 4853/75

[51] Int. Cl.[2] ..... A24C 5/52
[52] U.S. Cl. ..... 131/61 A; 131/67
[58] Field of Search ..... 131/61 A, 61 R, 61 B, 131/65, 67

[56] References Cited

U.S. PATENT DOCUMENTS

| | | | |
|---|---|---|---|
| 671,859 | 4/1901 | Gilliland | 131/61 R |
| 2,423,554 | 7/1947 | Davidson | 131/61 A |
| 2,847,999 | 8/1958 | Molins | 131/61 A |
| 2,979,058 | 4/1961 | Schur | 131/61 A X |
| 3,524,450 | 8/1970 | Molins et al. | 131/10 R |
| 3,854,487 | 12/1974 | Molins et al. | 131/61 A |

FOREIGN PATENT DOCUMENTS

| | | | |
|---|---|---|---|
| 569,486 | 5/1945 | United Kingdom | 131/61 R |
| 24,470 of | 1899 | United Kingdom | 131/61 A |

*Primary Examiner*—John F. Pitrelli
*Attorney, Agent, or Firm*—John C. Smith, Jr.

[57] ABSTRACT

Russian cigarettes are produced by an in-line system whereby tobacco sections are inserted between spaced tube portions. The tube portions may be fed as preformed tubes or as blanks in the form of flat strips or reverse folded strips for forming into tubes in a garniture. Russian cigarettes produced by this system are believed to have more uniform draw characteristics than conventional Russian cigarettes. Also disclosed is a method of producing Russian cigarettes having separate inner and outer tubes in which tobacco sections and pairs of inner tubes are intercalated on composite web sections, each of which comprise a central tobacco wrapper joined at each end to card sections for forming outer tubes. By precutting the composite web a continuous rod cut-off is avoided.

8 Claims, 9 Drawing Figures

Figures 1, 2, 4, 5, 6, 7:
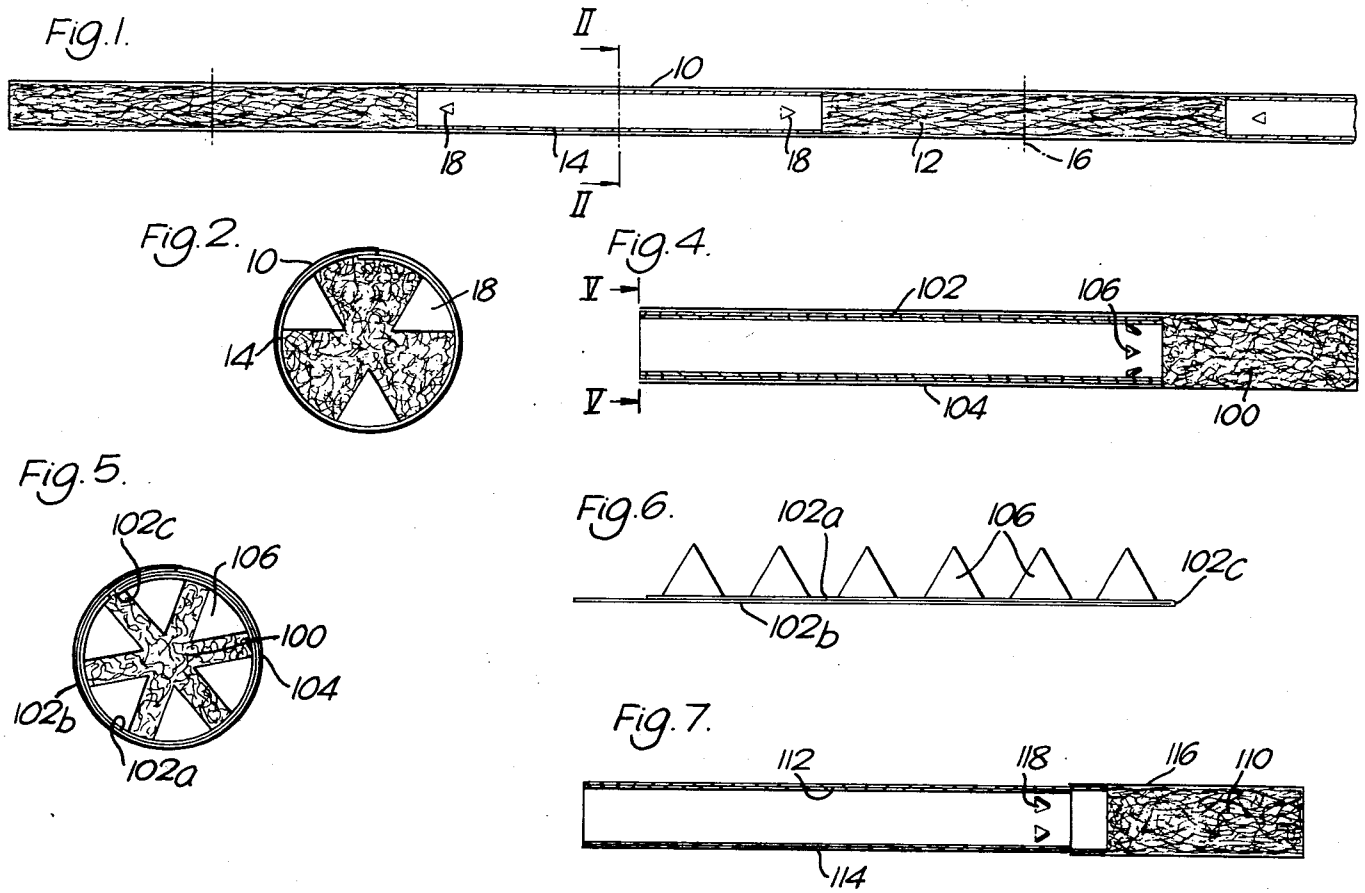

10
12
14
16
18
100
102
102a
102b
102c
104
106
110
112
114
116
118
II
V

METHOD OF MAKING RUSSIAN CIGARETTES

This invention is concerned with Russian cigarettes and with a method for making such cigarettes.

Russian cigarettes generally include a tobacco portion and an abutting (or overlapping) tube of relatively stiff paper-like material. As used herein the term "Russian cigarette" means a cigarette generally of this construction. The tube and the tobacco portions are usually enclosed in a common paper wrapper. The tube is normally hollow throughout its length but sometimes includes one or more filter portions which are usually positioned adjacent the tobacco portion. Conventionally the tube is formed of a spiral roll comprising at least two complete revolutions of a sheet of stiff paper and the inner layer of the roll is perforated to produce raised flaps which extend radially inwards into the hollow tube. These flaps are normally positioned near the end of the tube next to the tobacco portion and serve to prevent tobacco being drawn down the hollow tube; where the cigarette is provided with a filter the flaps are not necessary.

A known method for manufacturing Russian cigarettes comprises forming a tube of paper wrapper, cutting it into lengths and inserting a tobacco portion in one end of each tube and a preformed tube (e.g. of relatively stiff card) in the other end. This is a slow process and can be expensive in tobacco usage.

One aspect of the present invention comprises a method of making Russian cigarettes comprising forming a stream of spaced tobacco portions, forming a stream of spaced tube portions, intercalating the tobacco portions and the tube portions to form an alternating stream, wrapping the alternating stream in a wrapper web to produce a rod, and dividing the rod into individual Russian cigarettes.

The tube portions may be in the form of preformed tubes or flat strips for forming into tubes. The tube portions may comprise other blanks which may be formed into tubes. Thus the blanks may comprise substantially flat reverse folded strips of paper-like material having an upper part (preferably formed with upstanding flaps near one end) and a lower part joined to the upper part along a longitudinal reverse fold line and lying parallel to and below the upper part. The lower part is slightly wider than the upper part so that when the strip is bent to form a tube, the upper part being bent to form the inner roll of the tube, the lower part forms the outer roll and surrounds the inner roll and overlaps the fold line.

The tobacco portions and the tube portions may be of double the length required for the final cigarette, the rod being cut at the midpoints of each tobacco and tube portion. The tobacco and tube portions may be intercalated on the wrapper web. Preferably the tube portions are placed on the web upstream of the tobacco portions. The alternating stream may be wrapped in a garniture device; where the tube portions consist of preformed tubes these may be formed from flat strips in a second garniture device positioned upstream of the first device. Alternatively where the tube portions consist of substantially flat strips these strips may be formed into tubes at substantially the same time as or just before the alternating stream is wrapped. Thus the alternating stream of strips and tobacco portions may be intercalated on a wrapper web and the strips formed into tubes and the web wrapped around the alternating stream of tubes and tobacco portions in a single garniture device. Folded blanks for forming into tubes may be fed forward and formed into tubes either in a separate garniture device or in the garniture in which the stream of tobacco and tube portions are enclosed in a wrapper web.

Another aspect of the invention provides a Russian cigarette having a tobacco portion; a tube member having an inner roll extending around an angle of about 360° and an outer roll joined to the inner roll by a longitudinally extending reverse fold line, the outer roll extending around an angle of at least 360° so that it surrounds the inner roll and extends to the longitudinal fold line; and an outer wrapper surrounding at least part of the tobacco portion and the tube member. By having a reverse fold the outer roll is disposed so that it overlies the inner roll adjacent the fold line. Preferably the outer roll extends over an angle in excess of 360° so that it extends over the longitudinal fold line. In this case the overlapping part of the outer roll may be left unsealed if the whole length of the tube member is to be enclosed in a wrapper web. Alternatively if the overlapping outer roll is sealed the outer wrapper need only extend over the tube member by a distance sufficient to connect it to the tobacco portion. The inner roll may be formed with radially inwardly extending flaps near the end near the tobacco portion. Alternatively (or additionally) the tube member may contain a filter portion.

The folded blank used to produce the tube member may be of the same size and shape as a conventional blank for forming a spiral roll: in the present arrangement of course a fold is formed between the inner and outer rolls which is not present in the conventional blank or tube.

It should be noted that if perforations or cut-outs are provided in the inner roll to produce upstanding flaps as previously described they are normally covered in the completed cigarette by both the outer roll and the outer wrapper. If, however, a single layer tube (which may be of thicker and/or stiffer material) were used and this were provided with such cut-outs the latter would be covered only by the outer wrapper.

It is contemplated that the method of the present invention is applicable to the production of Russian cigarettes having separate coaxial inner and outer tubes. Thus the tube portions may comprise preformed separate coaxial inner and outer tubes. Alternatively the outer tubes (or both tubes) may be fed as flat or open strips. The inner tube preferably need not be as long as the outer tube. If cut-outs to produce radially extending flaps are required these may be formed in the inner tube. The outer tube can have an unsealed lap joint which is held in position by an outer wrapper extending over the whole length of the tube, or the tube may have a sealed longitudinal joint in which case the outer wrapper need only extend over the tube by a distance sufficient to secure the tube member to the tobacco portion. Similarly, although the inner tube is preferably sealed to maintain its shape it may be in the form of a separate roll maintained in shape by the outer roll (or outer wrapper). Where the inner tube is in the form of an unsealed roll it should preferably extend around an angle exceeding 360° and have an overlapping portion.

Yet another aspect of the present invention provides a method of making Russian cigarettes including the steps of joining alternating open outer tube portions and wrapper sections by their ends to form a continuous web, feeding tobacco portions onto the wrapper sections between the outer tube portions, intercalating inner tube portions with said tobacco portions so that said inner tube portions overlie at least part of said outer tube portions, and wrapping the wrapper sections around the tobacco portions and the outer tube portions around the inner tube portions.

The outer tube portions are preferably in the form of substantially flat strips when they are joined to the wrapper sections. The inner tube portions may be fed onto the outer tube portions as preformed tube members or alternatively they may be fed as substantially flat strips which lie on the outer tube portions. Where the inner tube portions are intercalated as flat strips they may be formed into tube members as the outer tube portions are wrapped around them. Adhesive may be applied either to the inner or outer tube portions to locate the inner tube portions as they are intercalated on the outer tube portions.

Both tube portions, the tobacco portions, and the wrapper sections can be of double the length required for an individual Russian cigarette. This method may therefore produce a continuous wrapped rod formed of alternating double length tobacco portions and double length tubes, joined by the overlap of the wrapper sections for the tobacco portions. Individual Russian cigarettes could then be produced by cutting the rod at regular intervals corresponding to the mid-points of the double length tobacco portions and the double length tubes.

In a preferred arrangement, however, double length wrapper sections are joined to double length outer tube portions to form a continuous web as before but the web is subsequently cut at the mid-points of the tube portions. Preferably the tube portions are cut prior to the feeding of the tobacco portions (of double length) onto the wrapper sections. A pair of adjacent single length inner tube portions is intercalated with each tobacco portion, one inner tube portion for each of the parts of the cut outer tube portion. After wrapping, the product is therefore a succession of rods, each comprising a double length wrapped tobacco portion having single length tubes joined to each end. Individual Russian cigarettes may be obtained by cutting at the mid-points of the tobacco portion whilst the rods are moved transversely, e.g. on a fluted drum. In this way the expense and noise of a high speed cut-off for a continuous rod can be avoided.

In either of the methods defined herein the stream of spaced tobacco portions may be formed in accordance with the method disclosed in British patent specification Nos. 1396318 or 1396595 or British patent application No. 25738/73 (U.S. Ser. No. 472,922, German OS No. 2425902).

Figure 3:
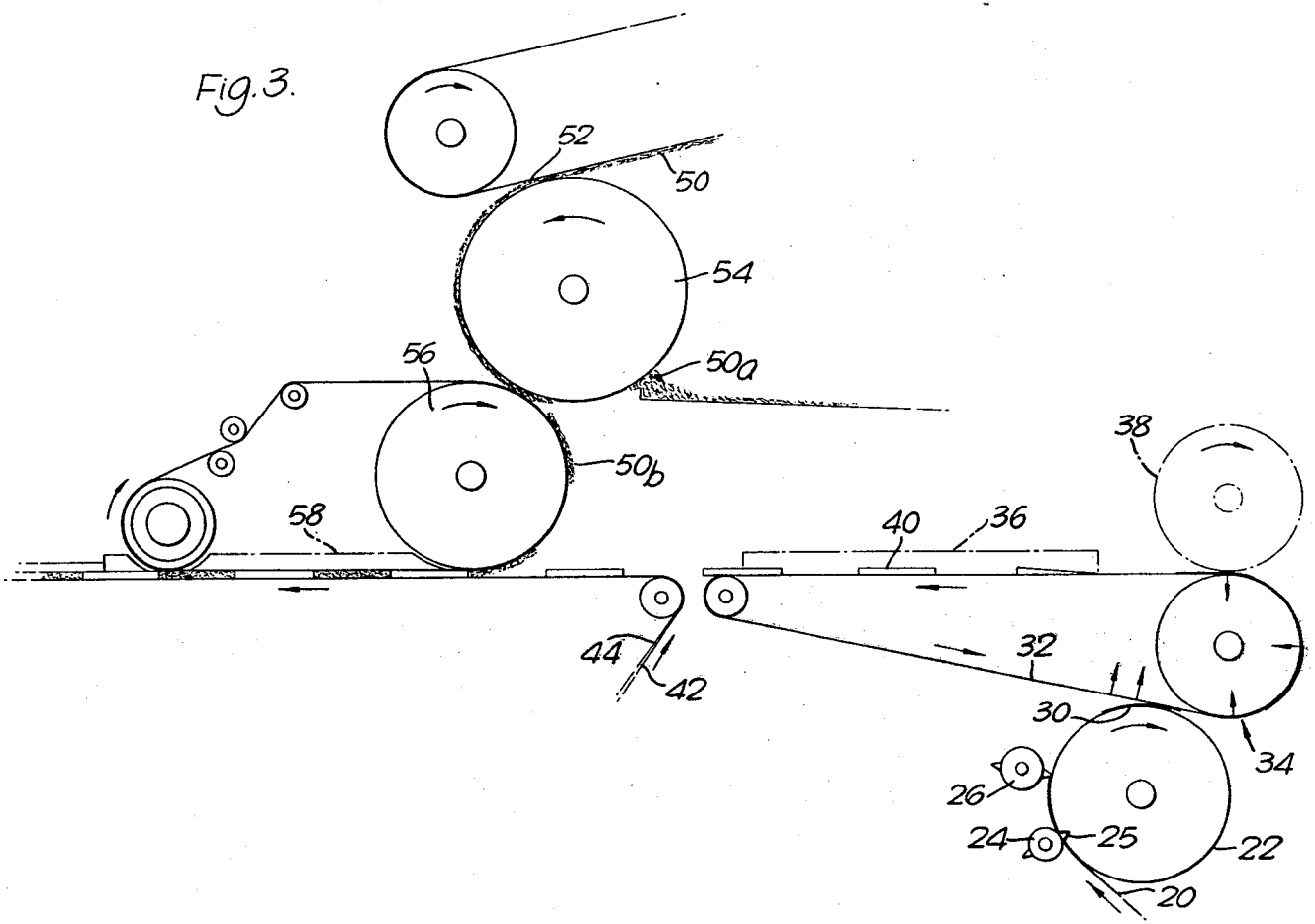
Figure 3A:
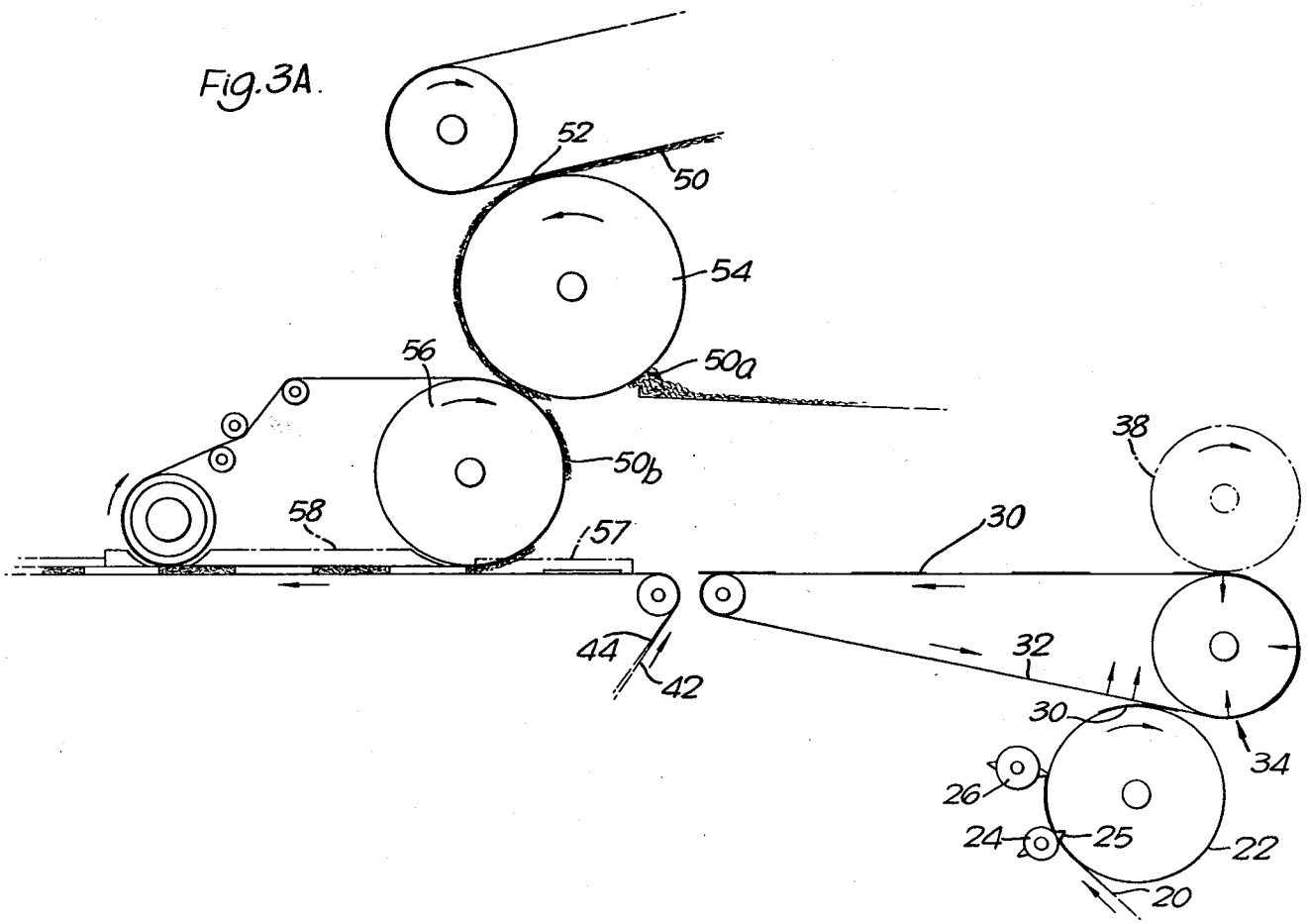
Figure 8:
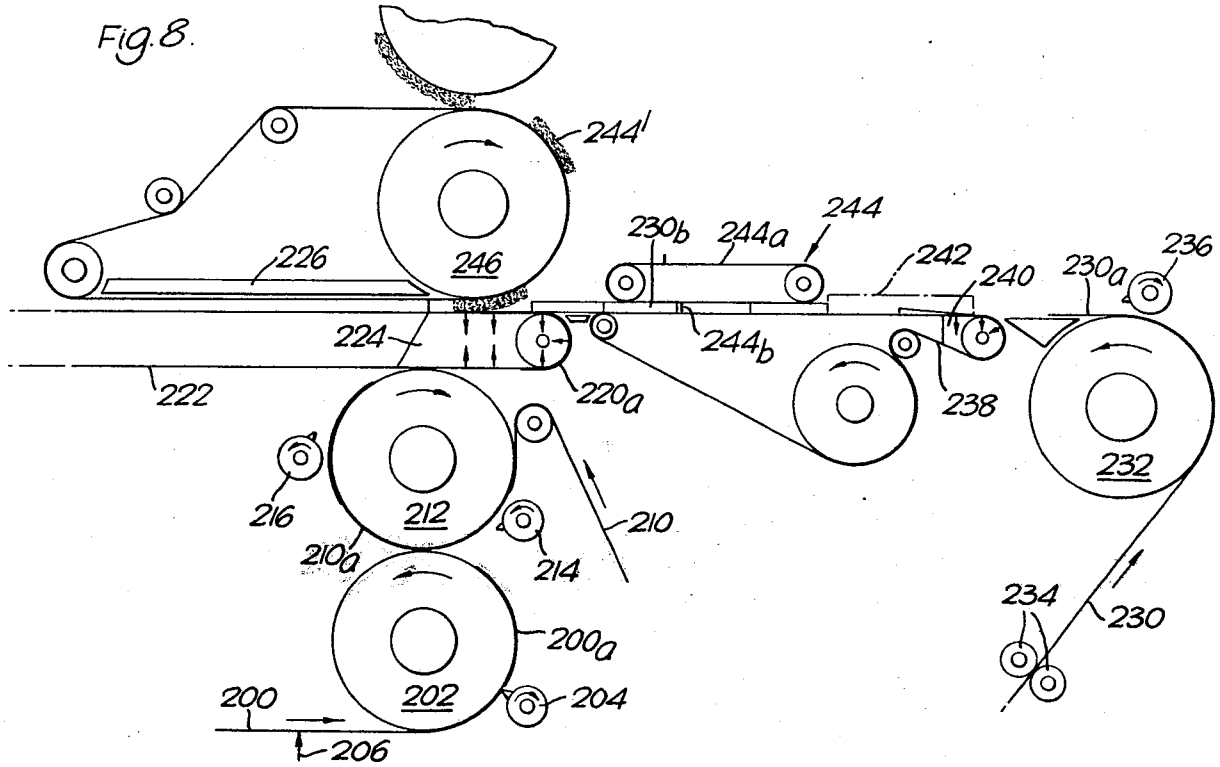

The invention will now be further described, by way of example only, with reference to the accompanying drawings in which:

FIG. 1 is a longitudinal section through part of a continuous Russian cigarette rod, FIG. 2 is a transverse section on the line II—II in FIG. 1, FIG. 3 is a diagrammatic elevation of apparatus for producing Russian cigarette rod, FIG. 3A is a diagrammatic elevation, similar to FIG. 3 of modified apparatus for producing Russian cigarette rod, FIG. 4 is a longitudinal sectional view of another construction of Russian cigarette, FIG. 5 is a transverse sectional view on the line V—V of FIG. 4, FIG. 6 is a transverse sectional view of part of the cigarette of FIG. 4 before assembly of the cigarette, FIG. 7 is a longitudinal sectional view of another construction of Russian cigarette, and FIG. 8 is a diagrammatic elevation of apparatus for producing the cigarette of FIG. 7.

Referring to FIGS. 1 and 2 a Russian cigarette rod comprises an outer paper wrapper 10 enclosing alternate tobacco portions 12 and card tubes 14. The portions 12 and tubes 14 are of double the corresponding length in an individual cigarette. To produce an individual cigarette from the rod, cuts are made at positions 16 corresponding to the mid-points of the tobacco portions 12 and the tubes 14. At positions near each end, each tube 14 is formed with three angularly-spaced triangular cut-outs 18 (FIG. 2) which are bent inwards to prevent tobacco being drawn down the tube when the cigarettes are smoked.

FIG. 3 shows an apparatus which may be used to produce the rod of FIG. 1. A web of card 20 is fed at a controlled speed onto a suction drum 22 rotating at a peripheral speed greater than the speed of the web 20. A drum 24 adjacent the drum 22 carries cutting members which make the cut-outs 18 at appropriate positions in the web 20. The drum 22 is provided with recesses as indicated at 25 to allow correct formation of the cut-outs 18. A rotary knife member 26 also arranged adjacent the drum 22 cuts the web 20 at predetermined positions against hardened inserts on the drum 22. Since the drum 22 is rotating faster than the speed of the web 20 the cut strips 30 of the web 20 are spaced apart by the drum. For further details of a cutting and spacing operation of this general type reference is directed to British patent specification No. 886,657.

The spaced cut strips 30 are received from the drum 22 by a suction band 32. Whilst on the band 32 the strips 30 are provided with a stripe of glue along one longitudinal edge by a lap pencil gluer 34. Subsequently the strips 30 are carried by the band 32 to a garniture tongue 36 where the strips are formed into tubes 40, the stripe of glue effecting the tube seal. In order that the tubes 40 should be sealed properly it is preferable for the garniture tongue 36 to have an extended tip which extends inside the tube underneath the lap joint so that a glue heater can press onto the joint against the tip of the tongue 36. It is possible that it may be desired to place one or more filter portions on the strips 30 before they pass into the garniture tongue 36: in this case the filter portions are placed on the strips by a wheel indicated at 38. From the suction band 32 the tubes 40 are passed onto a continuous paper wrapper web 42 carried by a garniture tape 44. The web 42 may previously have had adhesive applied at appropriate positions in order to locate the tubes 40.

A continuous tobacco stream 50 is formed by showering upwardly onto a suction band 52. The stream 50 is passed onto a suction wheel 54 where the stream 50 is divided into alternating first portions **50*a* and second portions 50*b*. The first portions 50*a* correspond in length and spacing to the length and spacing of the tubes 40 and are returned to the hopper for recirculation in the tobacco shower. The second portions 50*b* are transferred from the wheel 54 to a transfer wheel 56 where they are carried by suction onto the wrapper web 42 where they are released and intercalate with the tubes 40. The formation of the tobacco portions and the construction and operation of the wheels 54 and 56** is described and illustrated in the aforementioned British patent application No. 25738/73 (German OS No. 2425902). Other ways of producing spaced tobacco portions, which may be used with the present apparatus are described and illustrated in British patent specification Nos. 1396318 and 1396595.

After the tobacco portions 50*b* have been transferred onto the wrapper web 42 the resulting alternating stream of tubes 40 and tobacco portions 50*b* is passed on the web 42 into a garniture tongue 58 where the web is continuously wrapped and sealed around the stream to form the continuous Russian cigarette rod as shown in FIG. 1.

In an alternative arrangement shown in FIG. 3A, which is similar to FIG. 3 and in which similar reference numbers have been used where possible, the flat strips 30 are fed onto a wrapper web (and may be located thereon by appropriately placed adhesive) which corresponds to the web 42 in FIG. 3. As the strips are fed towards the transfer wheel 56 and garniture tongue 58 so they are bent into a U formation in a region 57 prior to being intercalated with the tobacco portions 50*b*. It may be noted that the cut-outs 18 which are present in the flat strips as in the tubes 40 may be helpful in preventing any tendency of tobacco from the portions 50*b* to spread over the surface of the strips. The stream of intercalated tobacco portions and partially formed tubes are subsequently fed into the garniture tongue 58 where formation of the flat strips into tubes is completed and the wrapper web is sealed around the stream of tobacco portions and tubes. The flat strips which are fed onto the web 42 may previously have been supplied with a stripe of adhesive to facilitate formation of the strips into tubes in thegarniture; however it is possible that the strips may be the garniture; into tubes and held in their tube formation simply by the continuous paper wrapper formed from the web 42.

In an alternative apparatus to that shown in FIG. 3 spaced flat card sections for forming into tubes are received on the wrapper which is supported by the garniture tape. Filter portions are fed onto the card sections (tube portions) and the stream passed through a device which forms the wrapper into a U-shape before receiving the spaced tobacco portions between the card sections. The wrapping and sealing is then completed, this final process also forming the card sections into tubes.

The Russian cigarette shown in FIG. 4 has a tobacco portion 100 and a tube member 102 enclosed in an outer paper wrapper 104 which extends over the length of the cigarette. The tube member 102 is of relatively stiff paper-like material. In a conventional Russian cigarette the tube member 102 would comprise a continuous spiral roll of this material. However, as can be seen from FIG. 5, the present tube member comprises an inner roll or part 102*a* and an outer roll or part 102*b* joined by a longitudinally extending reverse fold line at 102*c*. The inner part 102*a* extends around almost 360° so that its free end lies adjacent the fold line 102*c* and the outer part 102*b* extends around more than 360° so that it covers the end of the inner part and the fold line.

As with conventional Russian cigarettes the inner part 102*a* of the tube member is formed with angularly spaced triangular cut-outs 106 which are bent inwards to form flaps which are intended to prevent tobacco being drawn down the tube when the cigarette is smoked. Where the cigarette is provided with a filter, which may be cotton wool positioned in the tube adjacent the tobacco, the cut-outs 106 may be omitted.

FIG. 6 shows the tube member 102 in a flat folded condition prior to assembly into the cigarette of FIG. 4. The tube members 102 in this form may replace the strips 30 (which are formed into tube portions 40) in the assembly of the Russian cigarette of FIG. 4 by the apparatus of FIG. 3 or FIG.3A.

FIG. 7 shows another construction of Russian cigarettes having a tobacco portion 110, an inner tube 112, an outer tube 114 and an outer paper wrapper 116 which encloses the tobacco portion and which is adhesively secured to the adjacent end of the outer tube. Both the inner and outer tubes are formed with longitudinal lap seams. The inner tube 112, which is slightly shorter than the outer tube 114, is provided with triangular cut-outs 118 as before. Alternatively, a filter could be provided preferably in the end of either the inner or the outer tube nearest the tobacco portion or in the other end of the inner tube. As compared with conventional Russian cigarettes of the same size the construction of FIG. 7 can offer a saving in material of about 62% in the outer wrapper 116 and of about 3½% in the material for the tubes 112, 114.

The construction of the cigarette of FIGS. 4 and 5 may be modified so that the outer wrapper 104 extends over the tube member 102 only by so far as is necessary to secure the tobacco portion 100 to the tube member. In order for the tube member to have an acceptable form it would then be necessary for the free end of the outer part 102*b* to be longitudinally sealed down onto the underlying outer part 102*b*.

Referring now to FIG. 8, apparatus suitable for the production of the cigarette of FIG. 7 is shown. A web 200 of card for the outer tube 114 is fed at a controlled speed onto a suction drum 202 rotating at a peripheral speed greater than the speed of the web 200. A rotary knife member 204 adjacent the drum 202 cuts the web 200 at predetermined positions against hardened inserts on the drum so that the web is cut into sections 200*a*, each having a length corresponding to double the length of the outer tube 114 in an individual Russian cigarette. Since the drum 202 is rotating faster than the speed of the web 200 the cut sections 200*a* of the web are spaced apart by the drum. For further details of a cutting and spacing operation of the general type used on drum 202 (and also used elsewhere in the present apparatus), reference is directed to British patent specification No. 886,657. Prior to being cut the web 200 is pasted with adhesive (by an applicator at 206) at positions corresponding to the ends of the strips 200*a*.

A web 210 of paper for the outer wrapper 116 is fed at a controlled speed onto another suction drum 212 arranged adjacent the drum 202. A rotary knife member 214 cuts and spaces the paper into sections 210*a* in a manner similar to that already described with reference to drum 202. Each of the paper sections 210*a* has a length corresponding to double the length of the outer wrapper 116 in an individual Russian cigarette.

The card sections 200*a* are fed from the drum 202 onto the drum 212. The spacing of the card sections 200*a* on drum 202 and of the paper sections 210*a* on drum 212 are such that the card sections are fed between the paper sections. For this purpose the speeds of drum 202 and 212 are preferably equal. The card sections 200*a* overlap the paper sections 210*a* slightly (by the amount of overlap present in FIG. 7) and, since the ends of the card sections carry adhesive, the card and paper sections are joined into a comtinuous web on drum 212. This continuous web is subsequently cut on the drum 212 by a rotary knife member 216 at the mid-points of the card sections 200*a*. Thus at the knife 216 the web is cut into composite sections 220*a* which comprise a double length paper section 210*a* with a single length card section (i.e. half a section 200*a*) adhesively joined to each end. After cutting the composite sections 220*a* (which remain adjacent each other on drum 212 since there is no speed differential to produce spacing) are supplied to a garniture tape 222 passing around a suction chamber 224 into a garniture 226. The speed of tape 222 is preferably equal to the peripheral speed of drums 212 and 202.

A web 230 of card for the inner tube 112 is fed at a controlled speed onto a further suction drum 232. Before being fed onto the drum 232 the web 230 is fed through rollers 234 which are provided with means for making the cut-outs 118 at appropriate positions in the web. A rotary knife member 236 is arranged adjacent the drum 232 to cut the web 230 into sections 230*a*, each having a length corresponding to a single length of the inner tube 112 in an individual cigarette. The sections 230*a* may be spaced by the differential speed of the web 230 and the drum 232, or by a differential speed of the drum 232 and a tape 238 to which the sections are fed by the drum, or by a combination of both.

The tape 238 passes around a suction chamber 240 near the drum 232 and carries the sections 230*a* through a garniture 242, which may be identical to the garniture 36 described with reference to FIG. 3. As with the FIG. 3 arrangement filter portions may, if desired, be placed on the sections 230*a* before entry into the garniture 242. In the garniture 242 the sections 230*a* are formed into inner tubes 230*b* with a longitudinal seam. The inner tubes 230*b* are carried out of the garniture 242 by the tape 238 and under a timing member 244.

The timing member 244 comprises a band 244*a* carrying projections 244*b*. The band 244*a* is driven at the same speed as the garniture tape 222. The speed of the tape 238 is slightly less than that of the garniture tape 222. As the spaced inner tubes 230*b* are fed from the garniture 242 by the tape 238 the timing member 244 collates them in pairs by means of the projections 244*b* which engage the trailing ends of alternate tubes. After engagement by one of the projections 244*b* the trailing tube of a pair of tubes collated by the timing member 244 is driven forward relative to the tape 238 (i.e. at the speed of the garniture tape 222) until it abuts the leading tube, whereafter both tubes are fed onto the garniture tape 222.

Feed of the pairs of inner tubes 230*b* onto the garniture tape 222 is synchronised with the feed of the composite sections 220*a* by the tape. Each abutting pair of inner tubes 230*b* is fed onto the outer tube card sections (200*a*) of the composite sections 220*a*. The division between the pair of inner tubes corresponds to the division between adjacent composite sections, i.e. each inner tube 230*b* lies over one half of a card section 200*a* as divided by the knife member 216. Adhesive could be applied to the card sections (200*a*) of the composite sections 220*a* (or to the inner tubes 230*b*) in order to securely locate the inner tubes 230*b*.

Spaced double length tobacco portions 244 are delivered onto the paper sections (210*a*) of the composite sections 220*a* by a transfer wheel 246 arranged over the garniture tape 222 and suction chamber 224. The tobacco portions 244 are intercalated with the pairs of single length inner tubes 230*b*. Formation of spaced tobacco portions and operation of a transfer wheel similar to wheel 246 are described and illustrated in the aforementioned British patent application No. 25738/73 (German OS No. 2425902). Other ways of producing spaced tobacco portions are described and illustrated in British patent specification Nos. 1396318 and 1396595.

Thus a stream consisting of closely adjacent composite sections 220*a* is delivered into the garniture 226 by the tape 222. Each composite section 220*a* carries a double length tobacco portion 244 lying over a double length wrapper section (210*a*) and single length inner tubes 230*b* lying at each end of the tobacco portion over single length outer tube sections (200*a*). In the garniture 226 the outer tube sections are wrapped around the inner tubes and the paper wrapper sections are wrapped around the tobacco portions and each is formed with a longitudinal seam. The product issuing from the garniture is therefore a double length Russian cigarette member comprising a pair of cigarettes with their tobacco portions (and their wrappers) joined. Individual Russian cigarettes can be produced by cutting the double length members at the mid-points of the tobacco portions, preferably while the members are moving transversely, e.g. in a fluted drum.

The apparatus and method described above has the advantage that the noise and expense of a continuous rod cut-off is avoided. However, by omitting the knife member 216 and the timing member 244, and by appropriately feeding double length inner tube portions, a continuous Russian cigarette rod could be produced. This would then be cut at the mid-points of the double length tobacco portions and also at the mid-points of the tubes to produce individual Russian cigarettes.

In another possible arrangement the composite sections 220*a* are spaced on the garniture tape 222. By appropriate spacing this arrangement could obviate the need for collating the inner tubes in pairs so that spaced single length inner tubes could simply be fed directly onto the garniture tape. In this arrangement in particular, but also in the other arrangements described, it could be advantageous to feed the inner tubes as strips onto the outer tube sections and reply on the main garniture 226 to form both the inner and outer tube members.

Although not shown in FIG. 8 or described specifically it should be realised that in the formation of longitudinal seams, either in the inner or outer tubes or in the paper wrapper, adhesive may be supplied in or prior to entry into the garniture. For example, the garniture 226 may include an adhesive applicator for sealing the longitudinal seam on the outer tube sections and the paper wrapper, whereas in the case of the inner tubes longitudinally sealed in garniture 242 adhesive may be appropriately applied to the web 230 before it contacts the drum 232.

In the apparatus of FIG. 8 the paper web 210 is cut on the drum 212 by the rotary knife member 214 and separated by the differential speed of the drum and knife member and the web. Since the spacing required of the paper sections 210*a* is quite large the speed differential should also be quite large and this could create problems of paper snatch. This could be overcome by a slack loop provision in the paper web feed or, alternatively, by perforating the web instead of cutting it. In this latter arrangement snatch can be deliberately used to separate the web at the perforations by providing a driving roller adjacent the drum and a pair of retaining rollers prior to the drum.

The apparatus of FIG. 8 may also be used to produce Russian cigarettes of the construction shown in FIGS. 4 and 5. The drum 202 can be used to feed spaced strips of the kind shown in FIG. 6 onto a continuous paper web supplied to drum 212 (the rotary knife members 214 and 216 not being used). Alternatively a composite web comprising alternating paper sections and strips as in FIG. 6 could be formed on drum 212 to produce a modified construction having a paper wrapper which extends only partly over the tube member. This would require the use of rotary knife member 214, and of knife member 216, if use of a continuous rod cut off were to be avoided.

I claim:

1. A method of making Russian cigarettes, each cigarette comprising axially adjacent tobacco and double-walled tube portions, each said tube portion comprising an inner tube and an outer tube; said method comprising feeding a plurality of reverse folded strip portions, each said strip portion comprising a first part for forming said inner tube and a second part for forming said outer tube, said first and second parts being joined along a longitudinal reverse fold line and lying substantially parallel to each other, said fold lines being parallel to the direction of movement of said strip portions; feeding a plurality of said tobacco portions so as to form an alternating stream of said strip and tobacco portions; forming said strip portions into said double-walled tube portions, each said inner tube comprising said first part and each said outer tube comprising said second part, and wrapping said alternating stream to produce a rod; and dividing said rod into individual Russian cigarettes.

2. A method as claimed in claim 1 wherein the tube portions are formed whilst in the alternating stream.

3. A method as claimed in claim 2 wherein the strip portions are formed into tubes and the alternating stream is wrapped at substantially the same position.

4. A method of making Russian cigarettes, each cigarette comprising axially adjacent tobacco and double-walled tube portions, each said tube portion comprising an inner tube and an outer tube; said method comprising feeding a plurality of reverse folded strip portions, each said strip portion comprising a first part for forming said inner tube and a second part for forming said outer tube, said first and second parts being joined along a longitudinal reverse fold line and lying substantially parallel to each other, said fold lines being parallel to the direction of movement of said strip portions; forming said strip portions into said double-walled tube portions with each said inner tube comprising said first part and each said outer tube comprising said second part; feeding a plurality of said tobacco portions so as to form an alternating stream of said tobacco and tube portions; wrapping said alternating stream to produce a rod; and dividing said rod into individual Russian cigarettes.

5. A method as claimed in claim 4 wherein the tube portions are formed with cut-outs which produce inwardly directed flaps in the tube of the Russian cigarette.

6. A method as claimed in claim 4 in which a filter portion is introduced onto each strip portion and the strip portion is formed into a tube portion around the filter portion.

7. A method of making at least one Russian cigarette, said cigarette comprising axially adjacent tobacco and double-walled tube portions, said tube portion comprising an inner tube and an outer tube; said method comprising feeding at least one reverse folded strip portion comprising a first part for forming at least one inner tube and a second part for forming at least one outer tube, said first and second parts being joined along a longitudinal reverse fold line and lying substantially parallel to each other, said fold line being parallel to the direction of movement of said strip portion; forming said strip portion into at least one double-walled tube with an inner tube comprising said first part and an outer tube comprising said second part; feeding at least one tobacco portion so as to form at least one assembly of alternating tube and tobacco portions in axially adjacent relationship; wrapping said assembly to produce a rod; and dividing said rod into individual Russian cigarettes.

8. A method of making at least one Russian cigarette, said cigarette comprising axially adjacent tobacco and double-walled tube portions, said tube portion comprising an inner tube and an outer tube; said method comprising feeding at least one reverse folded strip portion comprising a first part for forming at least one inner tube and a second part for forming at least one outer tube, said first and second parts being joined along a longitudinal reverse fold line and lying substantially parallel to each other, said fold line being parallel to the direction of movement of said strip portion; feeding at least one tobacco portion so as to form at least one assembly of alternating strip and tobacco portions in axially adjacent relationship; forming each strip portion into a double-walled tube with an inner tube comprising said first part and an outer tube comprising said second part and wrapping said assembly to produce a rod; and dividing said rod into individual Russian cigarettes.

* * * * *